United States Patent [19]

Hirabayashi et al.

[11] Patent Number: 4,860,436

[45] Date of Patent: Aug. 29, 1989

[54] METHOD OF MANUFACTURING A COMPACT SWITCH

[75] Inventors: Michio Hirabayashi, Ibaraki; Tosio Koizumi, Nara; Kiyotada Shibao, Amagasaki, all of Japan

[73] Assignee: 501 IDEC IZUMI Corporation, Osaka, Japan

[21] Appl. No.: 130,579

[22] Filed: Dec. 9, 1987

[51] Int. Cl.[4] ..... H01H 11/00

[52] U.S. Cl. ..... 29/622; 29/527.4; 29/884; 264/272.17; 264/275; 264/277; 337/365

[58] Field of Search ..... 29/622, 527.1, 527.4, 29/883, 884; 337/365; 264/272.17, 275, 277

[56] References Cited

U.S. PATENT DOCUMENTS

| | | | |
|---|---|---|---|
| 3,561,113 | 2/1971 | Burke | 29/418 |
| 3,729,817 | 5/1973 | DeRowen et al. | 29/527.1 |
| 4,159,563 | 7/1979 | Bauer et al. | 29/622 |
| 4,510,479 | 4/1985 | Merchant | 337/91 |
| 4,690,484 | 9/1987 | Oba et al. | 29/622 |

*Primary Examiner*—P. W. Echols
*Attorney, Agent, or Firm*—Pollock, Vande Sande & Priddy

[57] ABSTRACT

A method of manufacturing a compact switch includes steps of (a) forming a base by insert molding on terminal members such that terminal pins of the terminal members are extended downward through the base when the terminal members, one of which has a bimetallic plate-fixing portion and another of which has engaging grooves to be engaged with a movable spring member, are punched in a hoop member;

(b) fixing a bimetallic plate to the fixing portion of the one terminal member, a fixed contact being attached to a free end of the bimetallic plate which is displaced when temperature of the bimetallic plate is raised;

(c) bringing a movable spring member into engagement with the engaging grooves of the other terminal member, a movable contact to be faced to the fixed contact being attached to a free end of the movable spring member;

(d) bringing a lower end portion of a push button member into engagement with the movable spring member;

(e) cutting the terminal pins at predetermined positions from a lead frame of the hoop member and accommodating in a hosing a switch unit thus formed by the steps (a) to (d) to enable automated manufacturing process of the compact switch.

7 Claims, 6 Drawing Sheets

METHOD OF MANUFACTURING A COMPACT SWITCH

BACKGROUND OF THE INVENTION

1. Field of the Invention

This invention relates to a compact or small scale switch which opens the connection of a circuit so as to protect it when an overcurrent flows therethrough and to a method of manufacturing the same.

The invention also relates to a method of mounting a bimetallic plate in this type of compact switch.

The invention further relates to a method of mounting a movable spring member for use in this type of compact switch.

2. Related Art

A type of conventional compact switch is known such as the one disclosed in U.S. Pat. No. 4,510,479 in which a bimetallic plate interposed in an electrical connection line is bent by the heat generated when an overcurrent flows through the bimetallic plate so that a movable contact is brought into contact with, or moved from, a fixed contact by a snap action of a movable contact element supporting the movable contact. This type of compact switch is assembled in such a manner that necessary precision parts, including terminal members which constitute the body of a switch unit, a bimetallic plate, a movable contact element, and a fixed contact element, are respectively incorporated directly in a housing by manual operation. That is, in the process of assembling this type of compact switch, the bimetallic plate is angled so as to be set to a predetermined position after it has been fixed to a terminal member which is one of the constituents of the switch unit body, and the terminal member to which the bimetallic plate has been fixed and other necessary precision parts are thereafter incorporated into the housing directly and separately from each other by manual operation.

Also, in this type of conventional compact switch, the mechanism of the movable contact element that effects a snap action is constructed by using a movable spring member, and this movable spring member is independently and directly incorporated in the housing by manual operation.

However, in manual assembly, much time and labor and a great deal of concentration are required. This means that assembly process is complicated by having many steps of precision production, and the possibility of human errors and the total manufacturing cost are therefore increased.

Also, there is a possibility of changes occurring in the bending characteristics of the bimetallic plate when the plate per se is angled.

SUMMARY OF THE INVENTION

It is an object of the present invention to provide a method which overcomes the above-described problems at least partially, and which enables, in a simple manner, automation of the process in which a compact switch is manufactured.

It is another object of the present invention to provide a compact switch which can be automatically manufactured by using this method.

It is still another object of the present invention to provide a method which facilitates automation of the process of attaching a bimetallic plate to a terminal member and which ensuredly securely sets the bimetallic plate to a predetermined position without non-elastically bending it.

It is a further object of the present invention to provide a method which facilitates automation of the process of setting a movable spring member.

Therefore, the present invention provides in one of its aspects a method of manufacturing a compact switch comprising steps of:

(a) forming a base by insert molding on terminal members such that terminal pins of the terminal members are extended downward through the base when the terminal members, one of which has a bimetallic plate-fixing portion and another of which has engaging grooves to be engaged with a movable spring member are punched in a hoop member;

(b) fixing a bimetallic plate to the fixing portion of said one terminal member, a fixed contact being attached to a free end of the bimetallic plate which is displaced when temperature of the bimetallic plate is raised;

(c) bringing a movable spring member into engagement with the engaging grooves of said other terminal member, a movable contact to be faced to the fixed contact being attached to a free end of the movable spring member;

(d) bringing a lower end portion of a push button member into engagement with the movable spring member;

(e) cutting the terminal pins at predetermined positions from a lead frame of the hoop member and accommodating in a housing a switch unit thus formed by the steps (a) to (d).

These steps are not necessarily executed in this order. For example, the step (b) may be executed after the step (a).

In this method of manufacturing a compact switch in accordance with the present invention, a hoop member which is formed by punching to provide the terminal member is used, and, on the basis of this hoop member, the base is formed by insert molding; the bimetallic plate is fixed; the movable spring member is engaged; and the push button member is brought into engagement with the movable spring member. It is therefore possible to execute the above manufacturing steps (a) to (d) by exerting operations of automated machines on the hoop member situated on both sides of the hoop member supply or transfer line. The step (e) can be executed at the end of the line.

The present invention provides in another of its aspects a compact switch having:

first, second and third terminal elements made of metal strips situated in a same plane, intermediate portions of the first, second and third terminal elements being embedded in a resin base, and the first, second and third terminal pins for insertion connection at their lower portions;

a bimetallic plate fixed at its one end side to a bimetallic plate-fixing portion formed of an angled portion, the angled portion being formed by bending through 90 degrees an upper exposed portion of the second terminal element that is positioned at one of outermost ends of a row of the first, second and third terminal elements, the angled portion being further bent through 90 degrees at its one end on the side of the base, the other end of the bimetallic plate extending to a position in the vicinity of the third terminal element and having a first contact;

a fixed contct attached to an upper end portion angled by 90 degrees with respect to an upper exposed portion of the third terminal element;

a movable spring member having an intermediate portion in engagement with an engaging groove formed in an upper exposed portion of the first terminal element disposed between the second and third terminal elements, the movable spring member having a movable contact disposed at its one end which can be brought close to the third terminal element, the movable spring member thus engaged being capable of being elastically displaced so that the movable contact is moved away from a critical position between the first contact on the free end of the bimetallic plate and the fixed contact on the third terminal element; and a push button member capable of causing the movable spring member to be pressed so that the movable contact is brought into contact with the free end of the bimetallic plate;

wherein the switch is constructed such that the first contact of the bimetallic plate is made to displace the movable contact of the movable spring member beyond the critical point toward the fixed contact on the third terminal element when the bimetallic plate is heated by an overcurrent flowing through an electrical conducting path between the first and second terminal pins, and that the movable contact is brought into contact with the fixed contact on the third terminal element by the elasticity of the movable spring member.

The present invention provides in still another of its aspects a method of mounting a bimetallic plate in a compact switch having steps of:

fixing a bimetallic plate to a predetermined portion of at least one terminal member punched as a hoop member so that the bimetallic plate stands on the terminal member at a right angle;

forming a base by insert molding on the terminal member; and bending at a right angle a fixing portion of the terminal member to which the bimetallic plate has been fixed so that the bimetallic plate is disposed in a predetermined position on the base.

In this method, the bimetallic plate may be either of a type having a fixed contact attached to its top and a type having a movable contact disposed at its top. The base may be formed so as to have a guide groove into which the fixing portion is fitted when the bimetallic plate is turned at a right angle. In the step of fixing the bimetallic plate to the terminal member, the bimetallic plate can be fixed to an end of the terminal member before or after this end portion has been bent at a right angle.

Since, in this method of mounting the bimetallic plate in accordance with the present invention, the bimetallic plate is fixed to the terminal member punched as a hoop member before the base is formed, this process can be performed by using an automated machine such as robots which is exerted from opposite sides of the hoop member supply line, and there is no possibility of motions of the automated machine being obstructed by the base. The bimetallic plate can be set to a predetermined position even when the plate per se is not bent non-elastically. If, in this setting, the bimetallic plate is turned by bending the fixing portion of the terminal member to which the bimetallic plate is fixed and fitting this portion into the guide groove, the attitude of the bimetallic plate after turning can be determined accurately even when a force to restore the above angled portion in the fixing portion of the terminal member to its original position still remains.

The present invention provides in a further one of its aspects a method of setting a movable spring member in a compact switch having steps of:

forming a plurality of movable spring members arranged in a row by punching or blanking from a web-like plate and simultaneously providing each of the movable spring members with a reference hole into which a reference pin of an automatic assembly robot hand is inserted;

inserting the reference pin of the automatic assembly robot hand into the reference hole;

cutting out each of the plurality of movable spring members; and setting the movable spring member thus cut-out to a predetermined position in a switch unit by means of the automatic robot hand pinching the movable spring member.

In the method of setting the movable spring member in accordance with the present invention, a web-like plate in which the movable spring members are formed in succession by punching or blanking is used, thereby facilitating the operation of robot hand. Since the reference hole into which the reference pin of the automatic assembly robot hand is inserted is formed in a web-like plate, the movable spring member can be pinched by the robot hand while being accurately positioned by inserting the reference pin into the reference hole.

BRIEF DESCRIPTION OF THE DRAWINGS

The foregoing and other objects, features, and advantages of the present invention will be made clearer from the following more particular description of preferred embodiments referring to the accompanying drawings in which.

DESCRIPTION OF PREFERRED EMBODIMENTS

Figure 9:
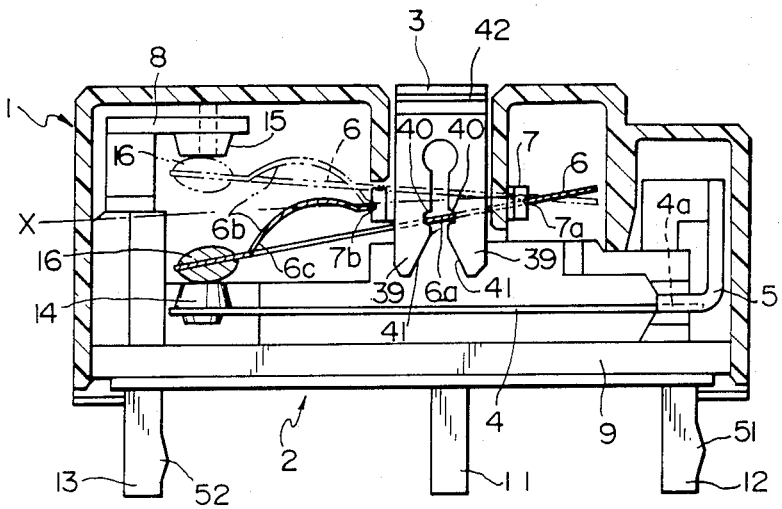
FIG. 9 is a vertical sectional front view of a compact switch manufactured in accordance with the method of an embodiment of the present invention.

A compact switch which is manufactured by a method in accordance with an embodiment of the present invention will be first described referring to an example which is illustrated in FIG. 9.

A compact switch, as shown in FIG. 9, is constituted by a box-like housing 1 and a switch unit 2 which is accommodated in the housing 1 and which is provided with an operating push-button member 3. The switch unit 2 is constructed as described below. A fixing portion 5 to which a base-end portion 4*a* of a bimetallic plate 4 is fixed, an engaging portion 7 having engaging grooves 7*a* and 7*b* in engagement with a movable spring member 6, and a stationary switch element or fixed contact element 8 are secured to a base 9 made of a dielectric material such as thermo-plastic or thermo-setting resin. A first terminal pin 11 which extends from the engaging portion 7, a second terminal pin 12 which extends from the fixing portion 5 and a third terminal pin 13 which extends from the stationary switch element 8 are extended through the base 9. A lower end portion of the push-button member 3 is in engagement with a bridging portion 6*a* of the movable spring member 6. A first fixed or stationary contact 14 is attached to a free end of the bimetallic plate 4, a second fixed or stationary contact 15 is attached to an end of the stationary switch element 8, and a movable contact 16 is attached to a free end of the moving spring member 6. The engaging grooves 7*a* and 7*b* are formed at different heights.

In the compact switch thus formed, the movable spring member 6 in a normal state is set at a first stationary position as indicated by the solid line in FIG. 9. When, in this normal state, an overcurrent flows through the electrical path between the first and second terminal pins 11 and 12, the bimetallic plate 4 is bent upward because of the rise in the temperature of the plate 4 by the Joule heat generated therein, and, in response to this bending, a movable end 6*c* of a snap spring 6*b* is gradually displaced upward. When the movable end 6*c* is raised beyond a critical line X of the snap spring 6*b*, the snap spring 6*b* bounces reversely and is changed from one stable condition to another stable condition. In response to this, the movable spring member 6 effects an upward snap action instantaneously until the movable contact 16 reaches the second fixed contact 15, and the movable spring member 6 is set at a second stationary position indicated by the double-dot chain line in FIG. 9, thus opening the electrical connection or contact between the first fixed contact 14 and the movable contact 16. Electrical equipment is thereby protected.

Since, in this compact switch, the direction in which the bimetallic plate 4 is bent when an over-current flow coincides with the direction in which the contact-closing force is exerted from the first fixed contact 14 to the movable contact 16, the contact pressure between the contacts 14 and 16 does not decrease until a moment immediately before the detachment of these contacts. That is, the contacts 14 and 16 can be moved apart from each other instantaneously after the stability of contact has been maintained. This is preferred in terms of the performance of a compact switch.

To return the movable spring member 6 to the initial state after the cause of the over-current has been eliminated, the push button member 3 is pressed. Then the movable spring member 6 is returned to the first stationary position.

Next, a method of manufacturing this compact switch, according to an embodiment of the present invention, which includes a step of mounting the bimetallic plate 4 and a step of setting the movable spring member 6 will be described hereinafter. This manufacturing method comprises a step (a) of forming base 9 in the manner of insert molding, a step (b) of mounting the bimetallic plate 4, a step (c) of setting the movable spring member 6, a step (d) of mounting the push button member 3, and a step (e) of fitting the switch unit 2 into the housing 1.

Figure 1:
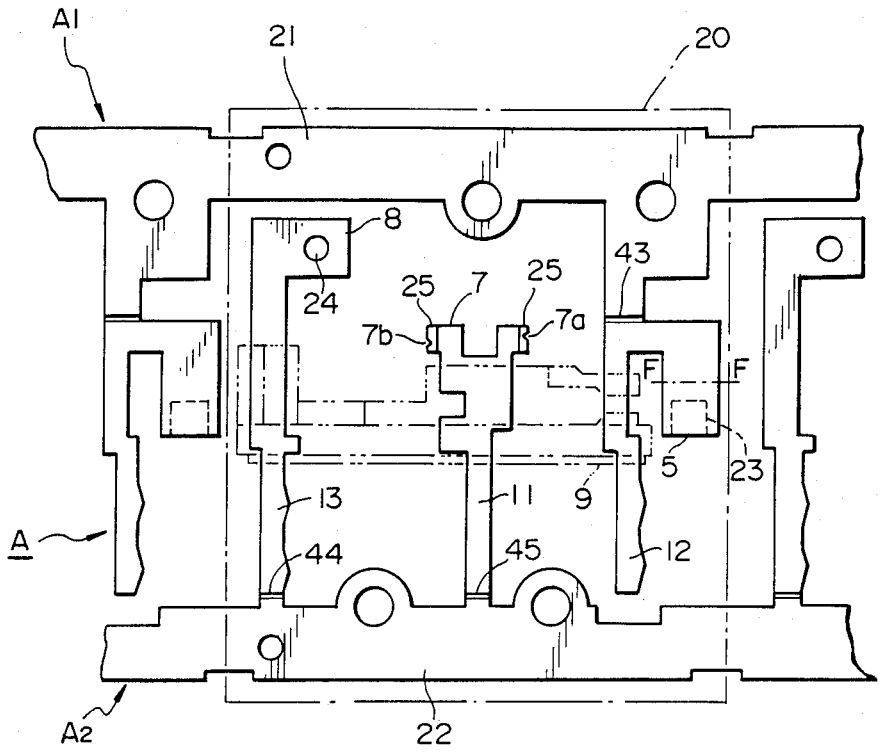
FIG. 1 is a front view of part of hoop members comprising terminal members.

FIG. 1 shows hoop members A having a group of punched terminal member portions 20. As can be understood from FIG. 1, the hoop members A are punched so that groups of terminal members 20 are formed at a constant pitch or regular intervals. Each group of terminal members includes the fixing portion 5, the engaging portion 7 having the engaging grooves 7*a* and 7*b*, the fixed contact element 8, and the first, second and third terminal pins 11, 12 and 13. Reference numerals 21, 22 represent lead frames of the hoop members A. The hoop members A shown in FIG. 1 are provided as two separate hoop members $A_1$ and $A_2$, the hoop member $A_1$ having the fixing portion 5 integral with the second terminal pin 12, and the lead frame 21, and the hoop member $A_2$ having the engaging portion 7 integral with the first terminal pin 11, the fixed element 8, integral with the third terminal pin 13, and the lead frame 22. However the hoop members A may be provided as one member integrally formed of the hoop members $A_1$ and $A_2$. Furthermore, a hoop member which is different from the hoop members A from which the terminal members 11, 12 and 13 are formed is used to form the bimetallic plate 4.

Figure 2:
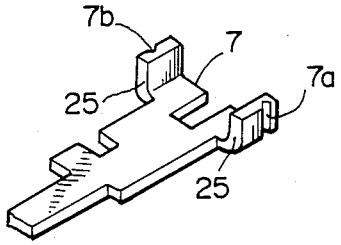
FIG. 2 is an enlarged perspective view of a part of the hoop member shown in FIg. 1.

When the hoop members A are formed by punching, a recess 23 for positioning the base-end portion 4*a* of the bimetallic plate 4 is formed in the fixing portion 5 of each group of terminal members, and an attachment hole 24 for attachment of the fixed contact 15 is also formed in the fixed contact element 8. As is clear from FIG. 2, the engaging portion 7 is provided with a pair of stand-up portions 25 in which the engaging grooves 7*a* and 7*b* are formed. The stand-up portions 25 and the engaging grooves 7*a* and 7*b* are also formed at the same time when the hoop members A are punched.

Figure 3B:
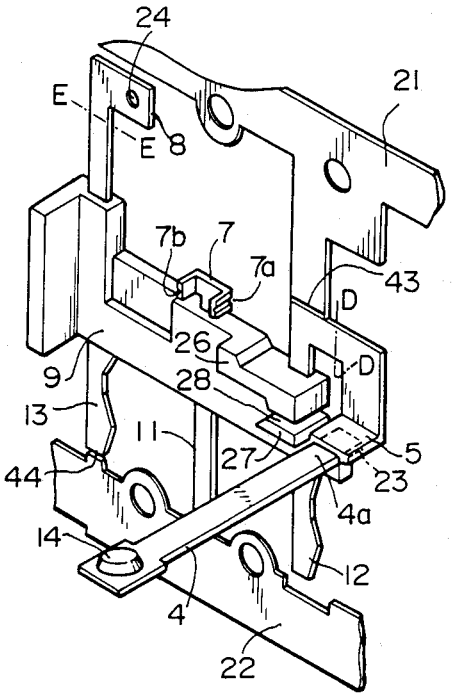
FIG. 3B is a perspective view of the hoop members after insert molding of a base.
Figure 3A:
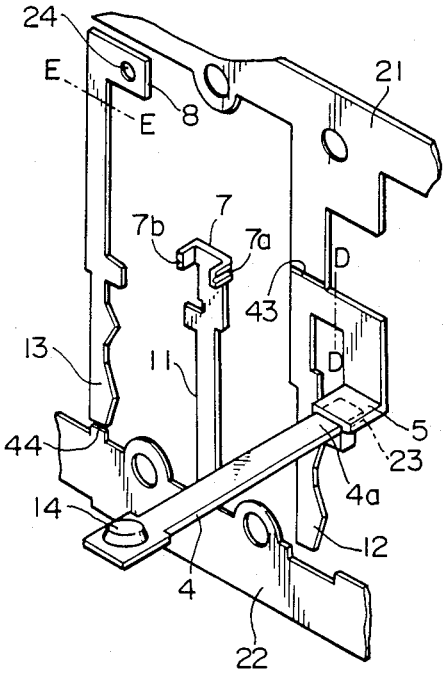
FIGS. 3A illustrates, in the form of a perspective view, the process in which a bimetallic plate is fixed to one of the terminal members so as to stand thereon at a right angle.
Figure 4:
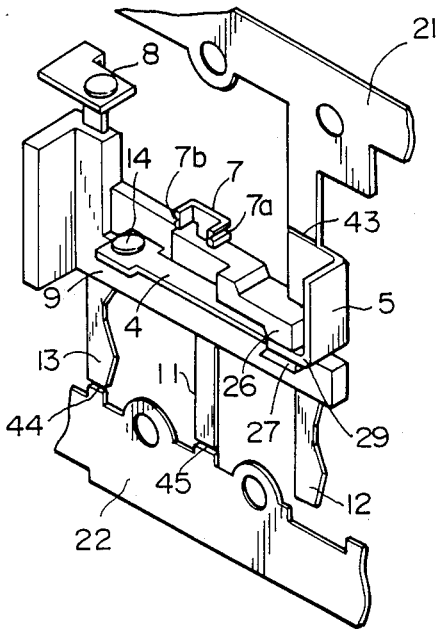
FIG. 4 illustrates, in the form of a partial perspective view, the state in which the bimetallic plate is disposed in a predetermined position.

In the step (b) of mounting the bimetallic plate, the base-end portion 4*a* of the bimetallic plate 4 is fixed to the fixing portion 5 bent at a right angle as shown in FIG. 3A. The bimetallic plate 4 can be fixed by any means such as spot welding or caulking using rivets. However, the method of previously forming the positioning recess 23 in the fixing portion 5 is preferred in terms of automation of the step (b) because the bimetallic plate 4 can be positioned accurately only by fitting the base-end portion 4*a* into the recess 23. To fix the bimetallic plate 4, it is advantageous to previously make the fixing portion 5 stand vertically by bending the fixing portion 5 along the bending line F—F in FIG. 1 because this operation enables an automatic fixing machine to move to the fixing portion 5 without being obstructed by the members such as the lead frame 22, the second terminal pin 12, and the adjacent third terminal pin 13.

After the bimetallic plate 4 has been fixed in this manner the base 9 is formed by insert molding on the hoop member(s) A maintained to be disposed in the same position(s) (relative to each other) (step (a)). As shown in FIG. 3B, this insert molding is performed while the hoop member(s) is(are) positioned such that the first, second and third pins 11, 12 and 13 are projected downward below the base 9. If, as described above, the two separate hoop members $A_1$ and $A_2$ are provided, the hoop members $A_1$ and $A_2$ are integrally connected to each other by the base 9.

Figure 5:
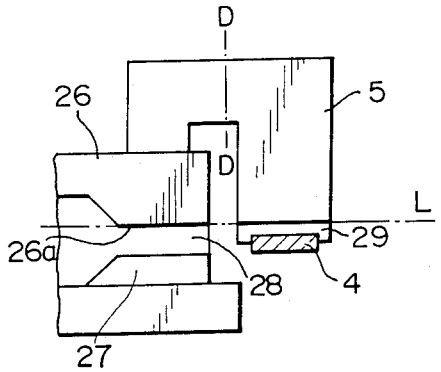
FIG. 5 is an enlarged front view illustrating the function of a guide groove.

After the base 9 has been formed by insert molding, the fixing portion 5 to which the bimetallic plate 4 has been fixed in the step (b) is bent at a right angle along the bending line D—D in FIG. 3B. The bimetallic plate 4 is thereby disposed in a predetermined position along the base 9. As shown in FIG. 5 in detail, projections 26 and 27 are formed at an end of the base 9 so that they are spaced apart from each other through a gap 28 therebetween in the vertical direction which serves as a guide groove 9refer to FIGS. 3A, 3B and 5) adapted to guide to position the bimetallic plate 4 therein in the vertical direction. In other words, when the fixing portion 5 is bent, a portion 29 thereof at which the fixing portion 5 and the bimetallic plate 4 is connected is fitted into the groove 28 in such a condition that upper and lower side faces of the portion 29 are contacted with the opposed faces of the projections 26, 27. It is therefore possible to accurately determine the attitude of the bimetallic plate 4 even when there remains a force restoring the bent portion along the bending line F—F to its original position. Errors in the current value at which the movable spring member 6 starts the snap action, that is, at which the compact switch operates are thereby reduced. As indicated by the chain line L in FIG. 5, the level of a lower surface 26*a* of the projection 26 and the level of an upper surface of the connecting portion 29 coincide with each other, and the connecting portion 29 is accurately positioned by using the lower surface 26*a* of the projection 26 as a reference surface. The fixed element 8 is bent at a right angle along the bending line E—E in FIG. 3B. A fixed contact 15 is attached to the fixed contact element 8 (refer to FIG. 9).

In the step (c) of setting the movable spring member 6, the movable spring member 6 is brought into engagement with the engaging grooves 7*a* and 7*b*.

Figure 6:
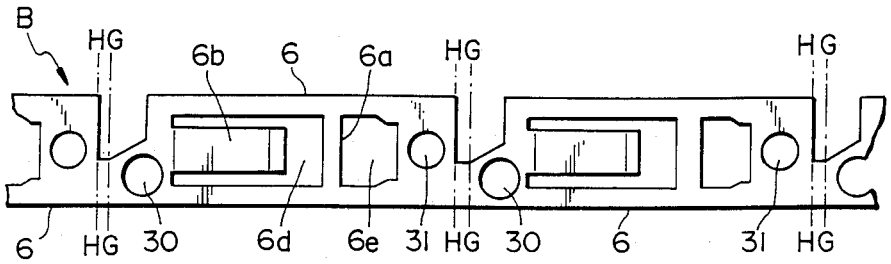
FIG. 6 is a front view of a part of a hoop member comprising movable spring members.
Figure 7:
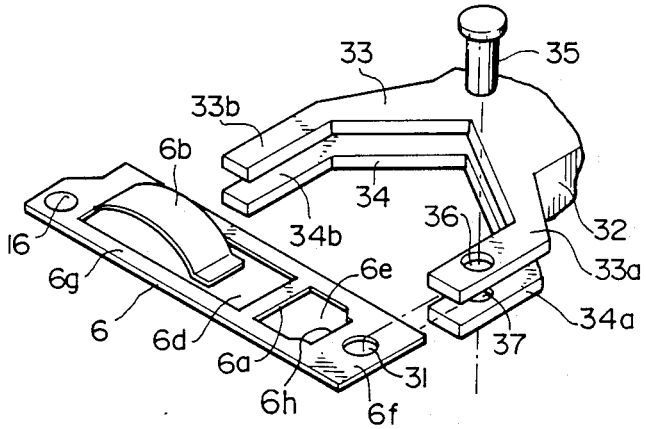
FIG. 7 is an exploded perspective view of the movable spring member to be pinched by a robot hand.

As shown in FIG. 6, the movable spring member 6 is formed by successively pressing a hoop member B in the form of a strip at a constant pitch. This hoop member B is supplied in synchronism with the supply of the hoop members A described above with reference to FIG. 1. The hoop member B is provided with an attachment hole 30 for attachment of the movable contact 16, and a reference hole 31 for positioning relative to an automatic assembly robot hand 32 which will be described later. The reference hole 31 is also formed at the same time when the hoop member B is pressed. As is clear from FIG. 7, opening 6*d* and 6*e* are formed on opposite sides of the bridging portion 6*a*, and the arcuate snap spring 6*b* formed in the opening 6*d* projects from the principal plane of the body portion of the movable spring member 6. As illustrated in FIG. 7, a robot hand 32 or manipulator 32 which is used to set the movable spring member 6 has a pair of forked arms 33 and 34 which are opened or closed by being moved downward or upward, and pin insertion holes 36 and 37 are formed in projections 33*a* and 34*a* of the arms 33 and 34 extending on one side thereof where the positioning pin 35 is inserted.

Figure 8:
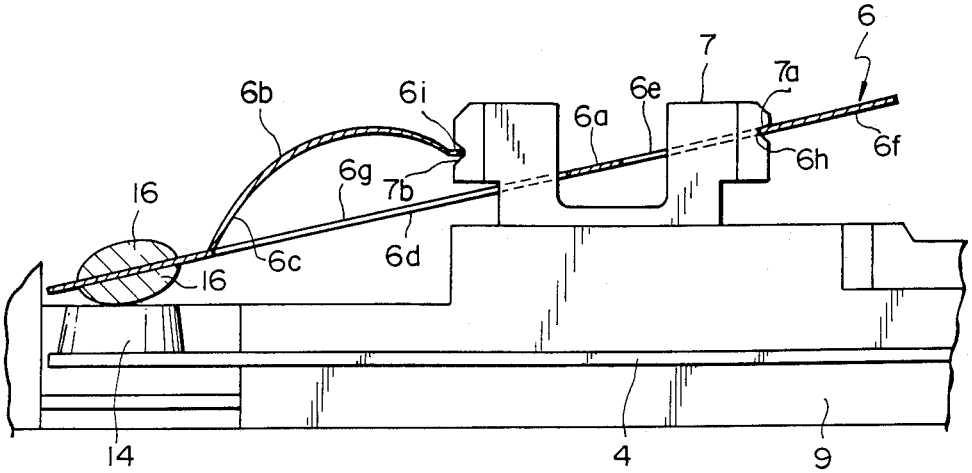
FIG. 8 is an enlarged front view of the movable spring member brought into engagement with engaging grooves.

When the robot hand 32 opens the arms 33 and 34, a base-end portion 6*f* of the movable spring member 6 is interposed between the projections 33*a* and 34*a*, and the longitudinal-side portions 6*g* of an opening 6*d* are inserted between projections 33*b* and 34*b* extending on the other side of the arms. The positioning pin 35 is thereafter made to fall into the pin insertion hole 36, the reference hole 31, and the pin insertion hole 37, thereby positioning the robot hand 32 and the movable spring member 6 relative to each other. In this state, the arms 33 and 34 are closed so as to pinch the movable spring member 6. Next, the robot hand 32 is brought close to the frame A so that the outer edge 6*h* of the opening 6*e* of the movable spring member 6 engages with the engaging groove 7*a* of the engaging portion 7 and, at the same time, a top end 6*i* of the arcuate spring 6*b* engages with the other engaging groove 7*b*. FIG. 8 shows the state in which the movable spring member 6 is set. After setting, the robot hand 32 releases the movable spring member 6 and returns to the initial state to be ready for the next operation. When the step (c) is executed, the movable spring member 6 is provided in such a manner that each movable spring member 6 is separated from the hoop member B by being cut along the cutting lines G—G and H—H.

In the step (d) of mounting the push button member 3, the lower end of the push button member 3 shown in FIG. 9 is brought into engagement with the bridging portion 6*a* of the movable spring member 6.

The punch button member 3 has a pair of branching legs 39, 39 a pair of recesses 40, 40 formed at intermediate portions of these legs 39, 39 and a pair of guide surfaces 41, 41 formed on lower half portions of the legs 39, 39,—the distance between these surfaces 41, 41 being increased toward the lower ends. The bridging portion 6*a* of the movable spring member 6 is fitted into the recesses 40, 40 with the aid of the guide surfaces 41, 41 while the legs 39, 39 are slightly opened. The push button member 3 and the movable spring member 6 are thereby brought into engagement as shown in FIG. 9. The push button member 3 also has a groove 42 formed in its upper-side portion over the periphery thereof.

In the step (e) of fitting the switch unit into the housing, the lead frames 21 and 22 shown in FIGS. 1, 3A, 3B and 4 are cut and separated from other members so as to form the switch unit 2, which are then accommodated in the housing 1. To separate the lead frames 21 and 22, recessed grooves 43, 44 and 45 may be previously formed at positions at which the lead frames are separated as shown in FIGS. 1, 3A, 3B and 4 in order to make cut-off positions definite and enable these frames 21, 22 to be cut off by a small force.

The above-described steps are executed in the manner of batch-type procedures or successively by exerting operations of automatic machines on the hoop members A, B from opposite sides of the line on which the hoop members A and B are transported.

Figure 10:
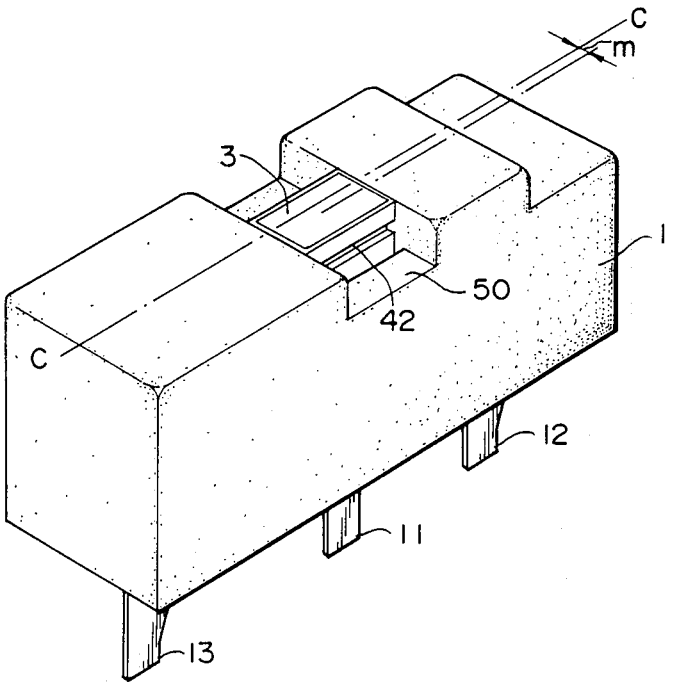
FIG. 10 is a perspective view of the compact switch shown in FIG. 9.

FIG. 10 is a perspective view of the appearance of a compact switch assembled in accordance with the above-described method. This compact switch has a recessed portion 50 formed in the upper surface of the housing 1 generally at the center thereof, and the top of the push button member 3 projects through the recessed portion 50. The upper surface of the push button member 3 is at the same level as that of the upper surfaces of the casing 1 on both sides of the recess 50. This enables some advantages to be effected. One of the advantages lies in that accidental pressing down of the push button member 3 can be prevented, and another advantage lies in that the state of contact setting, for example, the occurrence of an abnormal state in which an overcurrent flows through the circuit, can be noticed at a glance because the upper surface of the push button member 6 protrudes beyond the upper surfaces of the casing 1 when the movable spring member 6 effects the upward snap action. These advantages can also be realized by coloring the groove 42 of the push button member 3 and observing the position of the groove 42. If it is desired to open the connection of the circuit by manually causing the snap action of the movable spring member 6, a driver bit or the like may be inserted through the recessed portion 50, brought into engagement with the groove 42, and thereafter moved upward, thereby causing the snap action.

As in the case of the compact switch shown in FIG. 10, the position of the push button member 3 may be shifted from the center line C—C of the housing 1 by a predetermined dimension m in the widthwise direction. This makes it possible to equalize the intervals at which through-holes (Not shown) are formed in a printed circuit board and the intervals at which the terminal pins 11, 12 and 13 are disposed when two or more compact switches are arranged and mounted on the printed circuit board. If the terminal pins 12 and 13 are provided with wavelike projections 51 and 52 (refer to FIG. 9), the terminal pins 12 and 13 can be press-fitted into the through-holes.

The above manufacture process is directed to produce a type of compact switch in which the movable contact is released from the fixed contact so as to open a circuit when the bimetallic switch is bent, but the present invention can also be applied to the process of manufacturing a type of switch in which the switching operation reverse to the above case is performed, that is, the movable contact is brought into contact with the fixed contact so as to close a circuit when the bimetallic plate is bent.

As described above, the method of manufacturing the compact switch in accordance with the present invention enables all of the manufacturing steps to be performed by automatic machines, thereby eliminating the need for laborious manual operations and releasing operators from severe working conditions. This automation realizes mass production of compact switches of this type.

In the method of mounting the bimetallic plate of the compact switch in accordance with the present invention, the bimetallic plate is fixed and the terminal members are bent before the base is formed by insert molding. In addition, operations in these steps can be performed by automated machines such as robots and exerting operations of these machines from the opposite sides of the hoop member supply line, thereby enabling the automatic machines to fix and set the bimetallic plate to a predetermined position without any possibility of the motions of the automatic machines being obstructed by the base. The automation of the step of mounting the bimetallic plate enables mass production of compact switches of this type.

The method of mounting the bimetallic plate in the compact switch in accordance with the present invention also makes it possible to set the bimetallic plate to the predetermined position without non-elastically bending this plate per se but by bending the fixing portion of the terminal member, thereby preventing any change in the bending characteristics of the bimetallic plate and enabling manufacture of compact switches improved in the stability of operating characteristics and in the reliability.

The method of mounting the movable spring member in the compact switch in accordance with the present invention makes it possible to completely set the movable spring member only by the robot hand of the automatic machine. This automation of the step of setting the movable spring member enables mass production of compact switches of this type.

What is claimed is:

1. A method of mounting a bimetallic plate in a compact switch comprising the steps of:

fixing a bimetallic plate to a predetermined portion of at least one terminal member punched as a hoop member so that the bimetallic plate stands on the terminal member at a right angle;

forming a base by insert modling on the terminal member; and bending at a right angle a portion of the terminal member to which the bimetallic plate has been fixed so that the bimetallic plate is disposed in a predetermined position on the base.

2. The method according to claim 1, wherein the disposing of said bimetallic plate in the predetermined position of said base comprises:

fitting the bimetallic plate fixing portion into a guide groove formed in the base.

3. A method of manufacturing a compact switch comprising the steps of:

(a) punching to form two hoop members, each hoop member having a lead frame and at least one terminal member connected to the lead frame, a terminal member of one of the hoop members having a bimetallic plate fixing portion and the terminal member of the other of the hoop members having engaging grooves for engagement with a movable spring member;

(b) attaching a fixed contact to one end of a bimetallic plate, the one end of the bimetallic plate being displaced when temperature of the bimetallic plate is raised;

(c) fixing the bimetallic plate to the bimetallic plate fixing portion of the terminal member of the one hoop member;

(d) forming a base by insert molding on the terminal members, terminal pins of the terminal members extending downward through the base;

(e) attaching a movable contact, to be facing the fixed contact, to one end of the movable spring member;

(f) bringing the movable spring member into engagement with the engaging grooves of the terminal member of the other hoop member;

(g) bringing a lower end portion of a push button member into engagement with the movable spring member;

(h) cutting the terminal pins at predetermined positions from lead frames of the hoop members; and (i) accommodating in a housing a switch unit thus formed by steps (a) to (h).

4. The method according to claim 3, wherein the fixing and forming steps further comprise the steps of:

providing a hoop member separate from the hoop member from which the terminal members are formed for forming the bimetallic plate; and forming the base by insert molding on the at least one hoop member and the separate hoop member at the same time.

5. The method according to claim 3, further comprising the steps of:

angling a first part of the bimetallic plate fixing portion at a right angle before step (c); and angling a second part of the bimetallic plate fixing portion through 90 degrees to dispose the bimetallic plate in a predetermined position at the base, after the step (d), the second part being situated more remote from the bimetallic plate than the first part.

6. The method according to claim 5, wherein the disposing of the bimetallic plate in the predetermined position at the base in the second part angling step comprises fitting the bimetallic plate fixing portion into a guide groove formed in the base.

7. The method according to claim 3, wherein the movable spring member is one of a plurality of movable spring members arranged in a row and formed by punching from a web-like plate, the method further comprising the steps of:

forming a reference hole on each of the plurality of movable spring members during punching from the web-like plate;

inserting a reference pin of an automatic assembly robot hand into the reference hole of one of the movable spring members;

separating the movable spring member having the inserted reference pin from the plurality of movable spring members; and setting the separated movable spring member to a predetermined position in the switch unit by pinching the same with the automatic robot hand.

* * * * *